United States Patent [19]

Gerard et al.

[11] 4,337,887

[45] Jul. 6, 1982

[54] REINFORCED HALF SLOTTED CONTAINER

[75] Inventors: Thomas J. Gerard, Winter Haven; John E. Gillmore, Sr., Brandon, both of Fla.

[73] Assignee: Weyerhaeuser Company, Tacoma, Wash.

[21] Appl. No.: 76,641

[22] Filed: Sep. 18, 1979

[51] Int. Cl.[3] ..... B65D 5/56; B65D 5/00

[52] U.S. Cl. ..... 229/16 R; 229/37 R

[58] Field of Search ..... 229/16 R, 37 E, 34 A, 229/34 R, 37 R

[56] References Cited

U.S. PATENT DOCUMENTS

| | | | |
|---|---|---|---|
| 2,074,314 | 3/1937 | Fleischer | 229/34 A |
| 2,220,388 | 11/1940 | Beaman et al. | 229/37 E |
| 3,063,615 | 11/1962 | Bronte et al. | 229/37 E |
| 3,178,093 | 4/1965 | Wasyluka | 229/37 E |

*Primary Examiner*—Herbert F. Ross

[57] ABSTRACT

A half slotted container having side walls formed by outer side walls and reinforcing panels which are extensions from the upper edges of the outer side walls. The extensions fold over, are adhered to and contiguous with the side walls to form a double wall extending the entire height of the container to reinforce the container.

1 Claim, 9 Drawing Figures

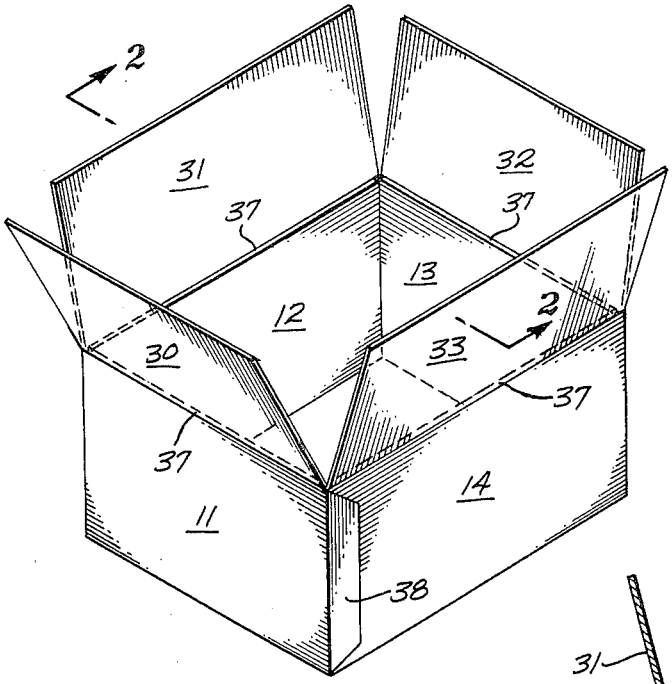
Fig. 1
Fig. 2
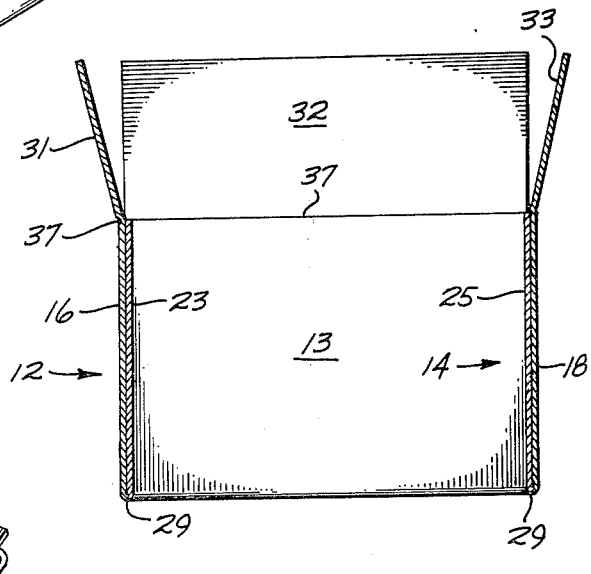
Fig. 7
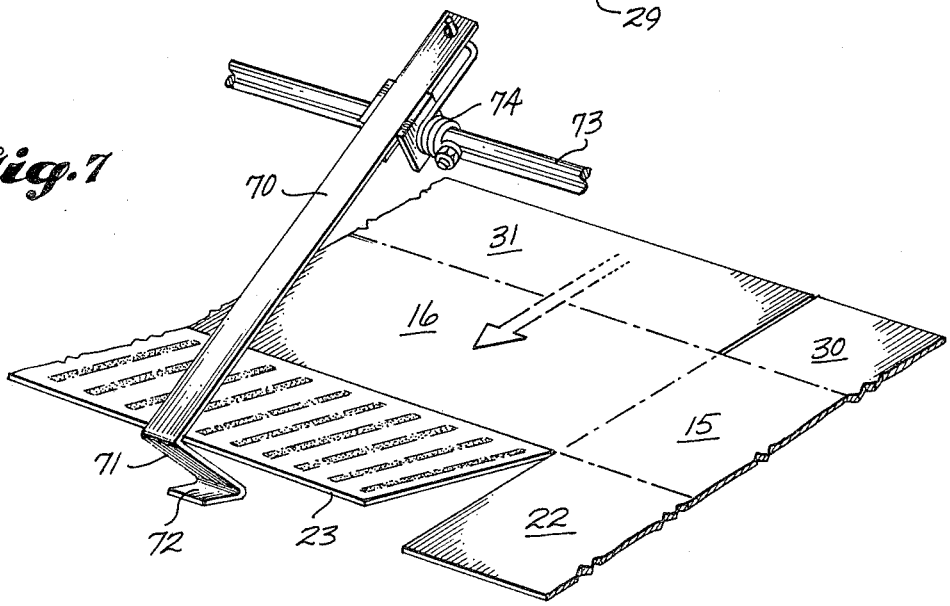

REINFORCED HALF SLOTTED CONTAINER

BACKGROUND OF THE INVENTION

1. Field of the Invention

A reinforced container.

2. Description of the Prior Art

Beaman, et al., U.S. Pat. No. 2,220,388, have an upper flange formed by extensions of the side walls which are folded down to overlie the upper edge of the side walls.

Wasyluka, U.S. Pat. No. 3,178,093, discloses a container in which an upper flange is formed by a number of panels which extend upwardly from the side walls and are folded around the upper edge of the side walls.

Bronte, et al., U.S. Pat. No. 3,063,615, also disclose a container having an upper flange reinforcement.

SUMMARY OF THE INVENTION

The purpose of this invention is to provide a container having reinforced side walls which does not have the usual problem of separate inserts. The present invention provides this by having a container formed from a unitary blank in which the outer side walls are reinforced by extensions of these walls which are adhered to the walls, which extend the full length of the walls to provide a total reinforcing structure and a structure in which the corrugations are supported.

BRIEF DESCRIPTION OF THE DRAWINGS

FIG. 1 is an isometric view of the container.

FIG. 2 is a cross section of the container taken along line 2—2 of FIG. 1.

FIG. 7 is a plan view of the device used for folding the reinforcing flaps over the outer side walls.

DESCRIPTION OF THE PREFERRED EMBODIMENTS

Figure 3:
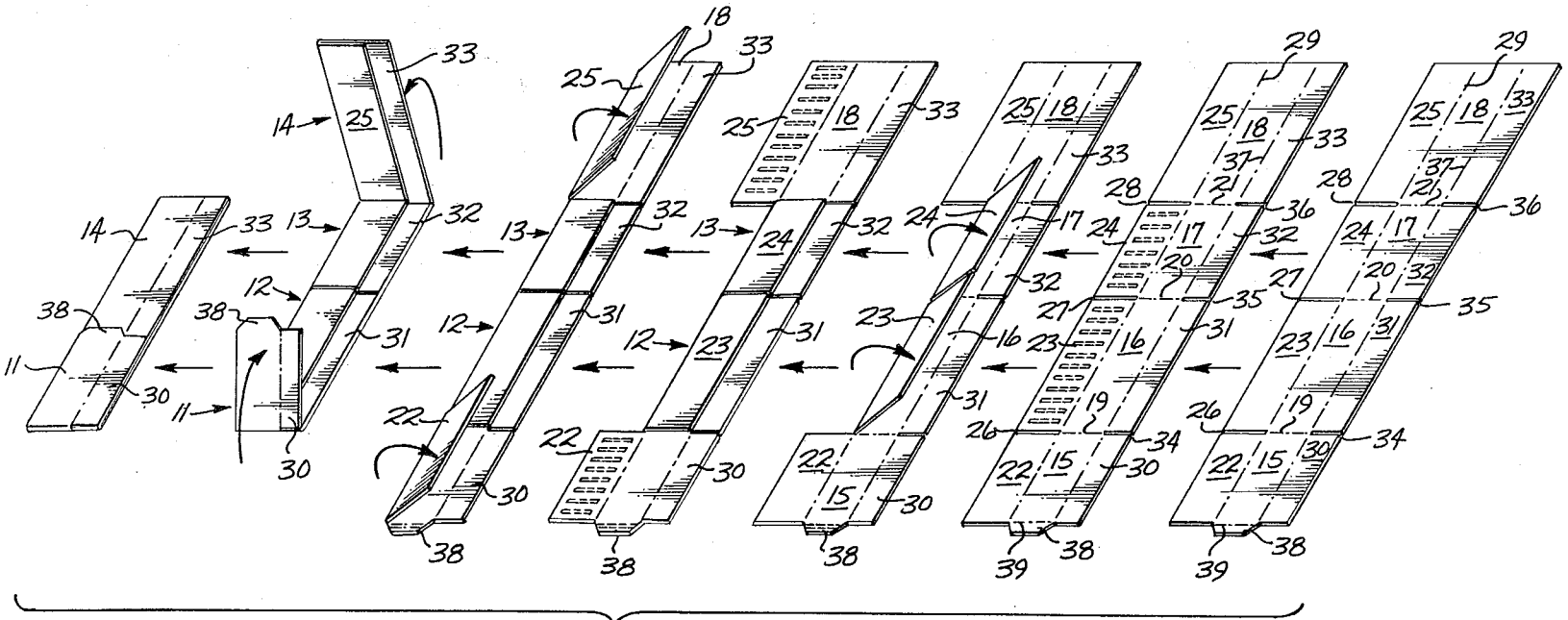
FIG. 3 is an isometric view of the flow of the container through the process showing the container being formed.
Figure 4:
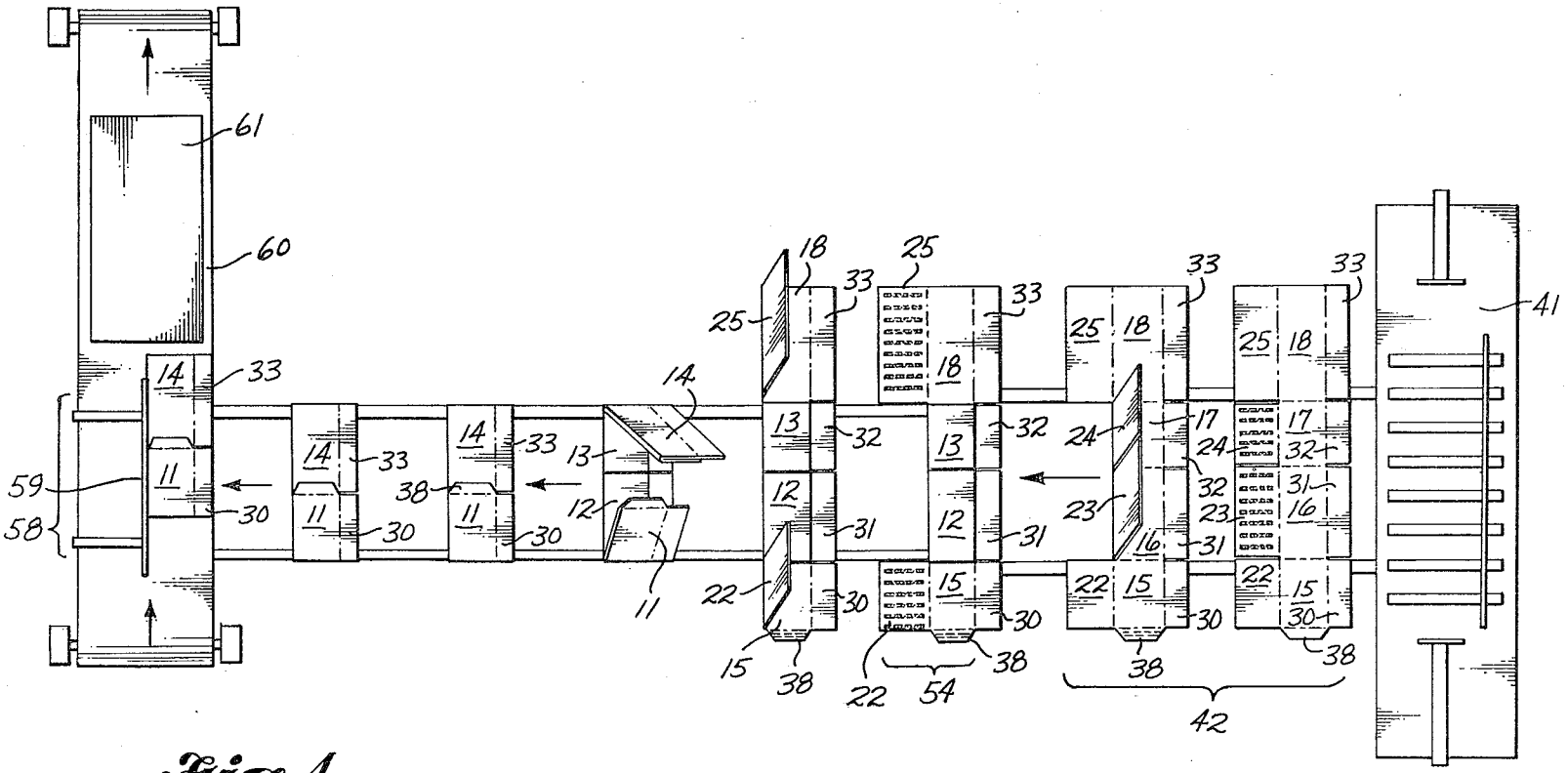
FIG. 4 is a top plan view of the apparatus and shows the container passing through the forming stations.

The container 10 has side walls 11, 12, 13 and 14. Each of these side walls is formed by an outer side wall and a reinforcing panel adhered to the outer side wall.

The outer side walls 15, 16, 17 and 18 are joined by score lines 19, 20 and 21 and the reinforcing panels 22, 23, 24 and 25 are separated by slots 26, 27 and 28 and each panel is attached to its outer side wall along score line 29. In the finished container each of the reinforcing panels is bent around score line 29 and adhered to its outer side wall to form the reinforced side wall.

The bottom closure panels 30, 31, 32 and 33 are also separated by slots 34, 35 and 36 and attached to outer side walls along score line 37.

The panel 38 is attached to outer side wall 15 along score line 39 and in the finished container is adhered to the outer edge of outer side wall 18 of side wall 14.

The reinforcing panels are of approximately the same size and of the same height as the outer side walls and provide additional support to the side walls because they extend to the bottom wall.

The container is formed by first placing glue on reinforcing panels 23 and 24 and folding them around score line 29 and adhering them to outer side walls 16 and 17 respectively. Glue is then placed on reinforcing panels 22 and 25 and the panel 38. The reinforcing panels are then folded around the score line 29 and adhered to outer side walls 15 and 18 respectively.

The side walls 11 and 14 are next folded around scorelines 19 and 21 respectively with the panel 38 overlying the outer edge of side wall 14. The panel 38 is then adhered to the side wall to form the four sides of the container.

Figure 5A:
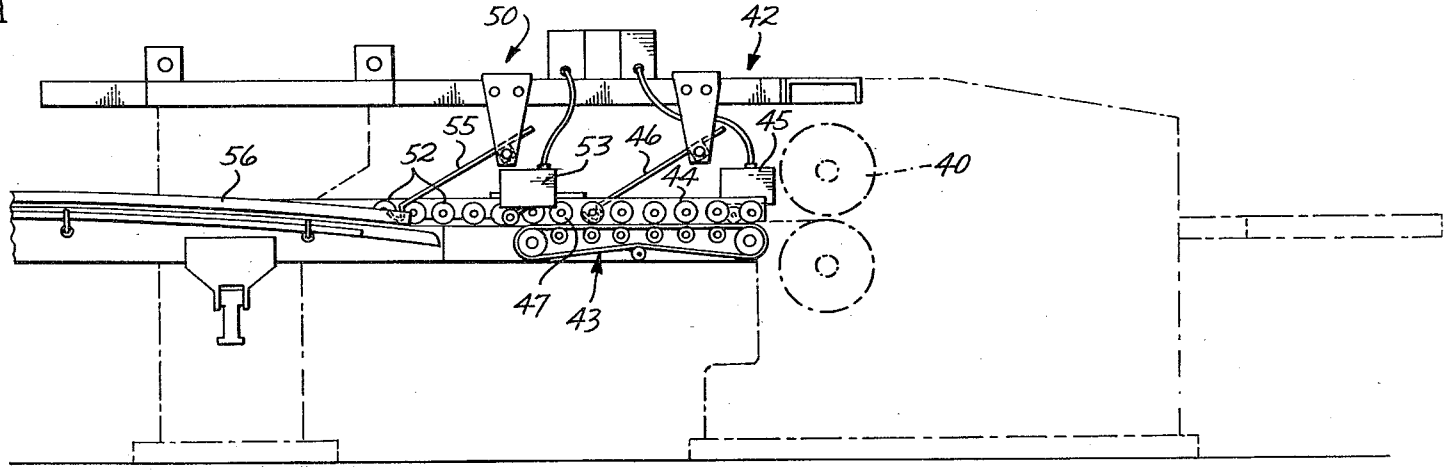
FIG. 5A and FIG. 5B are a side plan view of the apparatus for forming the container.
Figure 6A:
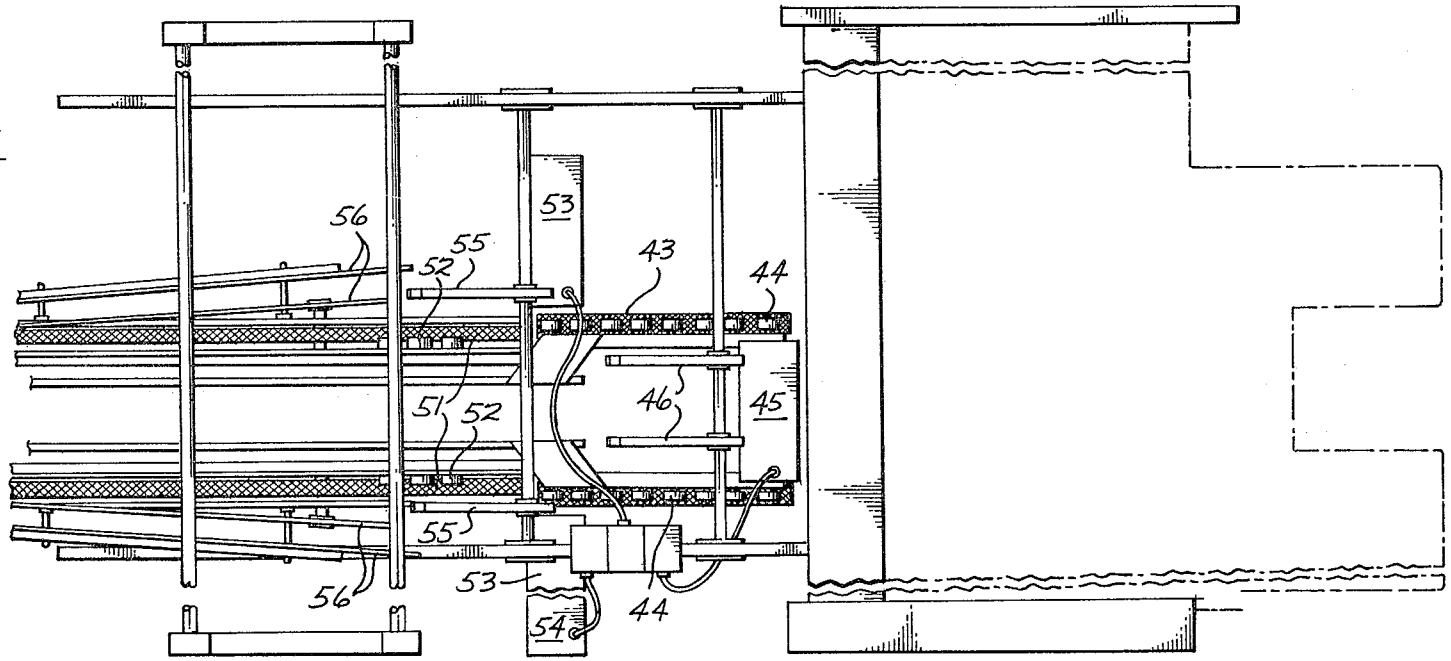
FIG. 6A and FIG. 6B are a top plan view of the apparatus.
Figure 5B:
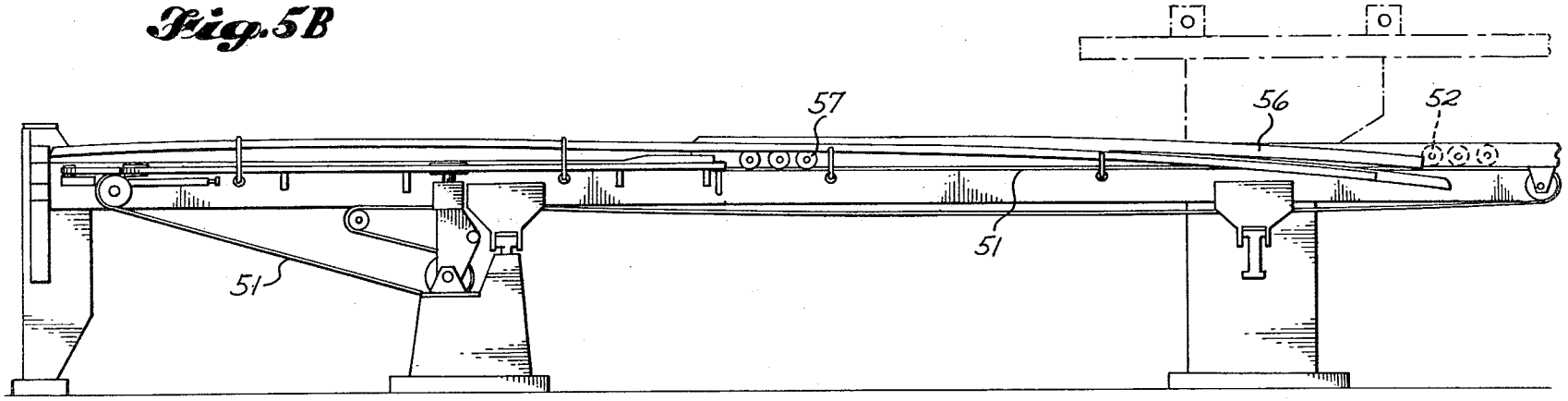
Figure 6B:
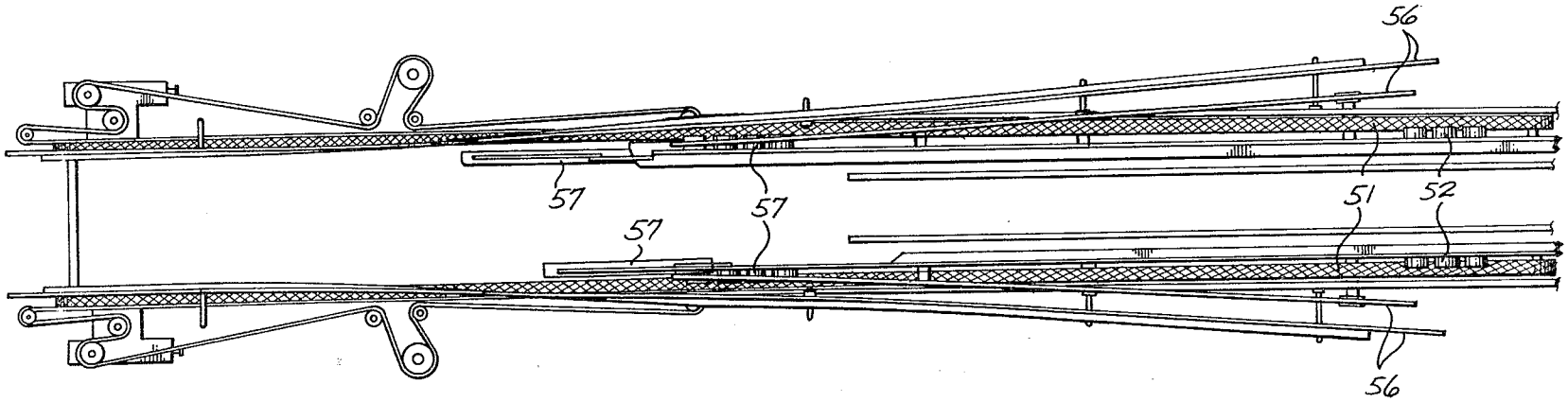

The apparatus to perform this process is shown in FIG. 5. The conveyor of feed rolls 40 on feed table 41 pushes the blank into the fist forming station 42. The reinforcing panels are the leading panels into the forming process. Conveyors 43 for the outlying panels carry the blank through this forming station. These conveyors are below the hold down bars or rollers 44 which are outward of score lines 19 and 21 and their respective slots 26 and 34 and 28 and 36. Gluing means 45 places glue on the upper faces of either the reinforcing flaps 23 and 24 or the outer side walls 16 and 17. The reinforcing flaps 23 and 24 are then folded over onto the outer side walls 16 and 17 by folding means 46 and are adhered to the outer side walls by the compression rolls 47.

The containers are transferred from the first forming station 42 to the second forming station 50 and are moved through the second forming station by a conveyor 51 which carries the interior side walls 12 and 13 through the process. In the second forming station the hold down bars or rolls 52 overlie the side walls 12 and 13 and the conveyor 51. They are shown as extensions of the compression rolls 47.

In this forming station glue means 53 places glue on the upper faces of either the reinforcing flaps 22 and 25 or the outer side walls 15 and 18 and glue means 54 places glue on the panel 38. Folding means 55 then folds the reinforcing panels 22 and 25 over the outer side walls 15 and 18 and applies pressure to adhere the reinforcing panels to the outer side walls to form side walls 11 and 14.

The blank is now carried through the next forming operation in which the exterior side walls 11 and 14 are folded over the interior side walls 12 and 13. The folding means or guides 56 fold the two exterior side walls around score lines 19 and 21 over the interior side walls 12 and 13. The side wall 14 is folded down before the side wall 11 so that the panel 38 will overlie the outer edge of side wall 14. The hold down shoes 57 are spaced from and extensions of hold down means 52.

The blank is carried into squaring station 58 in which the walls are squared by being pushed against a squaring edge 59.

A conveyor 60 carries the blank sideways into a compressor station 61 in which pressure is applied to finally glue the container together.

Folding and adhering the inner reinforcing panels and then the outer reinforcing panels means that there need be only one change in the location of the hold down means during the folding operation. It should be understood that the second forming station can be split into two sections if it is desired to adhere the outer reinforcing panels 22 and 25 before the inner reinforcing panels 23 and 24. In this instance the hold down means would first be within score lines 19 and 21, then outside of score lines 19 and 21 and then back inside score lines 19 and 21 for the last folding operation of the outer side walls 11 and 14 over the inner side walls 12 and 13.

The glue means 45 and 53 would normally be glue spray heads which would be actuated by the passage of the blank beneath the glue station. A Valco glue system, which uses glue heads of varying sizes to spray glue onto blanks, could be used for this installation.

The folding means 46 and 55 are shown in FIG. 7. The device is mounted above the conveyor and has a straight arm 70 with a detent 71 at approximately right angles to the arm. At the end of the detent is a pressure member 72 which would ride on top of the blank. The entire mechanism is mounted on a shaft 73 and is biased by spring 74 downwardly against the blank. As the blank moves forwardly, the front edge of the reinforcing panel is caught by the detent 71. The forward motion of the blank causes the reinforcing panel to fold upwardly around the score line 29. As the score line moves beneath the detent, the spring causes the arm to force the reinforcing panel down onto the outer sidewall and provide pressure on the reinforcing panel to adhere it to the outer sidewall.

The adhesive may be applied to both the reinforcing panel and outer side wall if desired.

What is claimed is:

1. A reinforced half slotted container formed from a single sheet blank comprising first, second, third and fourth side walls, each of said side walls being formed of an outer side wall and an inner reinforcing panel joined to said outer side wall along a first score line on the upper edge of said side wall, said side wall and reinforcing panel being formed from the same panel, said inner reinforcing panel being adhered to said outer side wall and being of a height equal to the height of said outer side wall and a width substantially equal to the width of said outer side wall, and bottom closure panels joined to each of said outer side walls along a second score line on the edge opposite said first score line.

* * * * *